US012729936B2

(12) United States Patent
Horrocks et al.

(10) Patent No.: US 12,729,936 B2
(45) Date of Patent: Sep. 8, 2026

(54) SHOOTING STALL BRASS SHIELD ADAPTOR SYSTEM

(71) Applicant: Action Target Inc., Provo, UT (US)

(72) Inventors: Connor Horrocks, Provo, UT (US); Robert DeCosta, Spanish Fork, UT (US)

(73) Assignee: Action Target Inc., Provo, UT (US)

( * ) Notice: Subject to any disclaimer, the term of this patent is extended or adjusted under 35 U.S.C. 154(b) by 239 days.

(21) Appl. No.: 18/437,247

(22) Filed: Feb. 9, 2024

(65) Prior Publication Data

US 2024/0271917 A1 Aug. 15, 2024

Related U.S. Application Data

(60) Provisional application No. 63/444,945, filed on Feb. 11, 2023.

(51) Int. Cl.
*F41J 11/02* (2009.01)

(52) U.S. Cl.
CPC ..... *F41J 11/02* (2013.01)

(58) Field of Classification Search
CPC ..... F41J 11/00; F41J 11/02; F41J 13/00; F41J 13/02; F41H 5/013; F41H 5/24
USPC ..... 273/410
See application file for complete search history.

(56) References Cited

U.S. PATENT DOCUMENTS

| | | | | |
|---|---|---|---|---|
| 5,259,291 | A * | 11/1993 | Wilson | F41J 13/00 273/410 |
| 10,048,046 | B1 * | 8/2018 | Iliev | F41H 5/04 |
| 2016/0178329 | A1 * | 6/2016 | Gibson | F41H 5/06 89/36.02 |
| 2018/0258636 | A1 * | 9/2018 | Rahmanian | F41H 5/24 |

* cited by examiner

*Primary Examiner* — Thomas M Sember
(74) *Attorney, Agent, or Firm* — BATEMAN IP; Randall B. Bateman

(57) ABSTRACT

A brass shield adaptor system includes a first brass shield and a second brass shield which are attachable together at a variety of locations to allow the brass shield adaptor system to rise a variety of heights above a shooting stall panel.

21 Claims, 5 Drawing Sheets

SHOOTING STALL BRASS SHIELD ADAPTOR SYSTEM

RELATED APPLICATIONS

The present application claims the benefit of U.S. Patent Application No. 63/444,945, filed Feb. 11, 2023, which is incorporated herein by reference.

BACKGROUND

State of the Art

In order to maintain proficiency in the use of firearms, it is common for law enforcement officers, members of the military, and the general public to practice at shooting ranges. Typically, a shooting range has a bullet containment system at one end to catch bullets and other projectiles which have been fired during training. At the other end, the area from which shooters fire their weapons is often divided into a number of stalls. The stalls usually include opposing ballistic panels which shield shooters from being inadvertently struck with a projectile in the event that one of the other shooters fails to properly use their firearm. Because of the relative positions that a shooter may discharge their weapon, the ballistic panels typically extend 6.5 to 8 feet above the ground. This provides acceptable protection to the other shooters.

While the ballistic panels protect the shooters from misfired weapons, many semi-automatic weapons discharge "hot brass." When a round is fired, the firing pin strikes the primer on the casing. Powder within the casing rapidly burns and emits gases which drive the bullet forward at a high rate of speed through the barrel of the gun. In order to fire the next round, the casing must be ejected from the weapon. With semi-automatic weapons this can be done with considerable speed and sufficient force to cause the casing to land 10 to 15 feet away from the user. Additionally, because of the small explosion which has just occurred inside the casing, the casing will usually leave the weapon being fairly hot.

Most semi-automatic weapons are designed to eject their casings at between about three o'clock (i.e., they fly out of the weapon generally perpendicular to the ground) and 4:30 (downward at about a 45% angle toward the ground) in such an orientation, the casings (often called "hot brass") will tend to ricochet off the panels of the shooting stall and are contained within or adjacent to the stall. However, if a gun is not maintained properly or is held at an angle for a variety of purposes, the hot brass may be ejected from the gun between an angle between about 1:00 o'clock and 2:00 o'clock. With such a trajectory, the hot brass can pass above the panel of the shooting stall and land on the person in the adjacent shooting stall, or even the shooting stall adjacent there too. Getting hit by hot brass is extremely uncomfortable and even getting hit by brass which has cooled sufficiently is still distracting at best and annoying.

In an attempt to overcome shooters being hit by brass from other shooters, Action Target has developed a brass shield which sits atop the panels of the shooting stall. The brass shield need not be made from ballistic material, but Action Target's brass shield reduces the amount of brass escaping a stall and impacting shooters in an adjacent stall. However, because shooting ranges have different ceiling heights over the stalls, it is still often possible for hot brass to pass over the brass shield and impact another shooter.

Thus, there is a need for a new shield which reduces the risk of brass passing into adjacent shooting stalls while allowing standard shooting stalls to fit in a variety of different locations.

SUMMARY OF THE INVENTION

The following summary of the present invention is not intended to describe each illustrated embodiment or every possible implementation of the invention, but rather to give illustrative examples of application of principles of the invention.

A shooting stall brass shield adaptor system may include a first brass shield which has a base configured for attachment to a shooting stall panel, and a second brass shield adjustably attachable to the first brass shield.

In accordance with one aspect of the application, the first brass shield may include a plurality of openings and the second brass shield may include a plurality of openings. One or more fasteners may be used to secure the first shield and the second shield to one another to thereby keep them in a desired orientation to one another and thereby prevent brass from passing above the shooting stall panels and into adjacent shooting stalls.

In accordance with another aspect of the application, the openings in the first brass shield and the second brass shield may be oriented to facilitate movement of the ends of the second shield in different orientations relative to the first brass shield so that the top of the second brass shield can adapt to ceilings which are sloped or otherwise irregular.

BRIEF DESCRIPTION OF THE DRAWINGS

Various embodiments of the present disclosure are shown and described in reference to the numbered drawings wherein.

Figure 1:
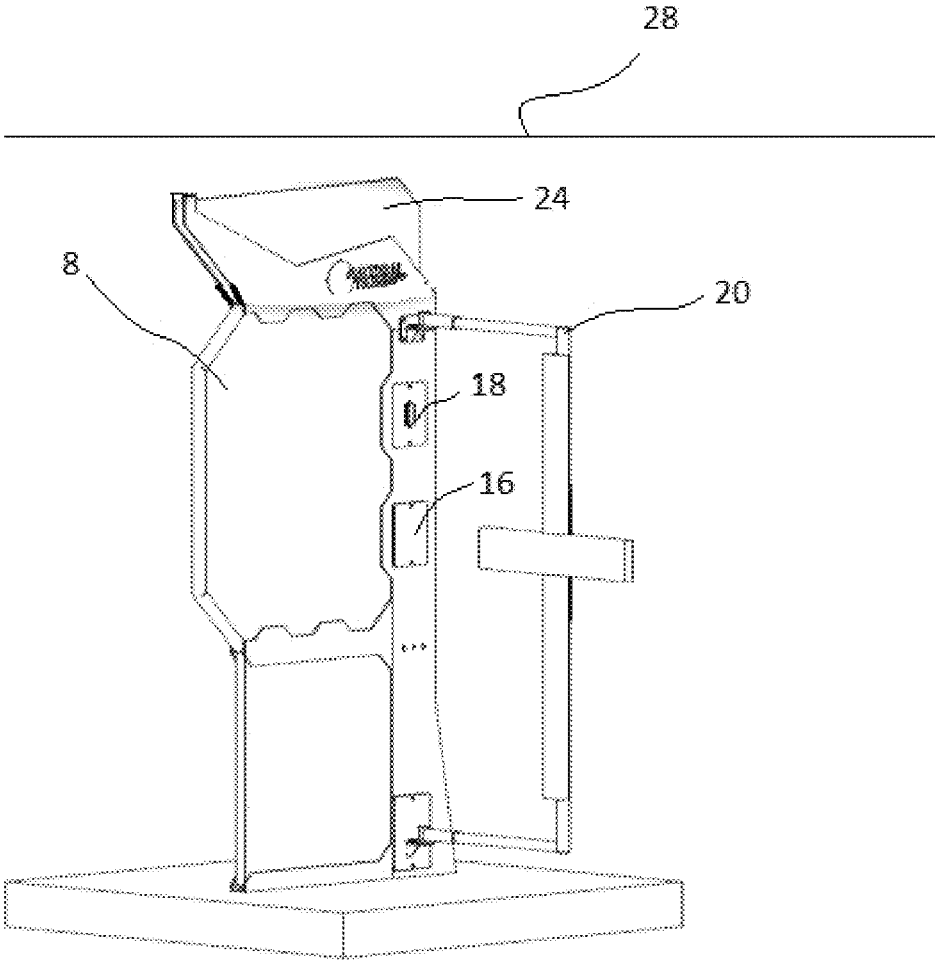
FIG. 1 (Prior Art)
FIG. 1 shows a perspective view of a shooting stall panel having a brass shield disposed on the top thereof in accordance with the prior art.

It will be appreciated that the drawings are illustrative and not limiting of the scope of the invention which is defined by the appended claims. The embodiments shown accomplish various aspects and objects of the invention. It will be appreciated that it is not possible to clearly show each element and aspect of the present disclosure in a single figure, and as such, multiple figures are presented to separately illustrate the various details of different aspects of the invention in greater clarity. Similarly, not all configurations or embodiments described herein or covered by the appended claims will include all of the aspects of the present disclosure as discussed above.

DETAILED DESCRIPTION

Various aspects of the invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and the descriptions thereof are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element of the invention to a single embodiment, rather the element may be included in other or all embodiments discussed herein.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "a bracket" may include an embodiment having one or more of such brackets, and reference to "the target plate" may include reference to one or more of such target plates.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "generally" refers to something that has characteristics of a quality without necessarily being exactly that quality. For example, a structure said to be generally vertical would be at least as vertical as horizontal, i.e., would extend 45 degrees or greater from horizontal. Likewise, something said to be generally circular may be rounded like an oval but need not have a consistent diameter in every direction.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Turning now to FIG. 1 there is shown part of a shooting stall made in accordance with the principles of the prior art. The shooting stall 4 may include a panel 8 which may be made from a ballistic material, such as hardened steel or bullet resistant composites. The panel 8 may includes controls 12 for performing tasks, such as a switch 16 for causing a retriever carrying a target to move toward or away from the shooter and a video screen 18 to allowing the shooter to observe information regarding the shooting session. A barricade 20 used for training may also be included.

The panel 8 may also include a brass shield 24 disposed on the top thereof. The brass shield is designed to deflect brass being ejected out of a gun from travelling over the top of the panel 8 and landing on a person in an adjacent stall. While this embodiment significantly reduces the risk of brass passing into an adjacent stall, the differing ceiling heights of shooting ranges can leave a gap between the top of the brass shield 24 and the ceiling represented by line 28.

The use of the term brass shield refers to the function of the shield and not necessarily the material from which the shield is made. The shield can be formed from plastics, metals and other materials which can withstand repeated impacts from hot brass. Plastics such as ABS, polycarbonate, and other hard materials are desirable due to their relative lightweight and durability.

Figure 2:
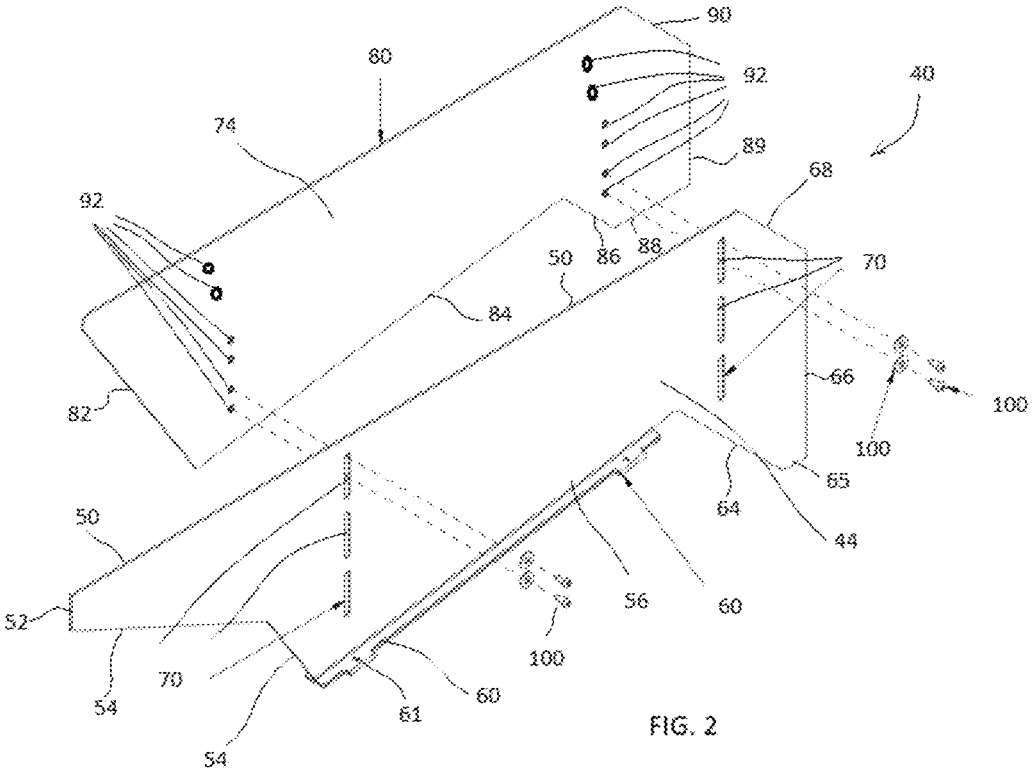
FIG. 2 shows a first brass shield, a second brass shield and fasteners in an exploded view.

Turning now to FIG. 2, there is shown a perspective view of a brass shield adaptor system, generally indicated at 40. The brass shield adaptor system 40 may include a first brass shield 44 and a second brass shield 74. The first brass shield adaptor may include a generally flat top surface 50, a short, generally flat front surface 52, and one or more downward sloping forward surfaces 54 extending downwardly and rearwardly from the front surface. The first brass shield may also include a generally flat to upwardly sloped center portion 56 along which a mounting bracket 60 is disposed. The mounting bracket 60 may include holes 61 for screws or other fasteners to secure the mounting bracket to a stall panel such as that shown in FIG. 1.

Rearwardly of the center portion 56 is a rearward portion 64 which extends downwardly and rearwardly from the central portion to a flat lower bottom surface 65 and a rear surface 66 which may be attached to the rearward portion and the upper surface by intervening surfaces 68. Such a shape enables the first brass shield to rest securely on top of an Action Target shooting stall panel, such as that shown in FIG. 1.

Unlike the brass shield 24 shown in FIG. 1, the first brass shield 44 in FIG. 2 includes a plurality of slots or openings 70 extending generally vertically. This may include openings 70 which are vertical or disposed at a slant. While three openings 70 are shown, the openings may include at least one opening and may include many openings depending on the size and shape of the openings.

Disposed adjacent to the first brass shield 44 is a second brass shield 74. The second brass shield 74 may include a generally flat top surface 80, a short, generally flat front surface 82 which may slope downwardly and rearwardly, and a generally flat to upwardly sloping central lower portion 84, a rearwardly sloping rear central lower portion 86, and a generally flat rear portion 87 which is disposed adjacent a nearly vertical rear surface 89 and rear upper surface 90 which slopes back to the generally flat top surface.

The second brass shield 74 may also include one or more openings 92, which may be formed as holes or slots in the second brass shield. One or more fasteners 100, such as screws and nuts, pivots, etc., may extend through the openings 70 on the first second brass shield 44 and the openings 92 on the second brass shield 74 to secure the first and second brass shields together. The respective openings 70, 92 may be oriented to allow the second brass shield 74 to move only vertically relative to the first brass shield 44. Alternatively, the openings 70 or 92 of either or both brass shields may be arranged so as to allow the second brass shield 74 to move both vertically and tilt lengthwise relative to the first brass shield so that the generally flat top surface 80 can abut a ceiling, even if the ceiling is not parallel to the ground.

Figure 3:
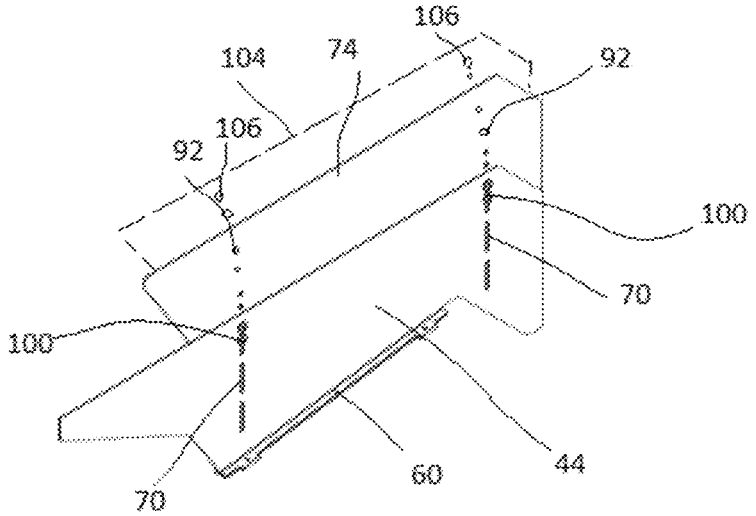
FIG. 3 shows a perspective view of the first brass shield, second brass shield and fasteners connected to form an adjustable brass shield for location on top of a panel of the stall.

FIG. 3 shows a perspective view of the first brass shield 44 being attached to the second brass shield 74 by the fasteners 100. The addition of the second brass shield 44 raises the height of the brass shield to reduce the risk of brass being ejected into adjacent stalls. The openings 70 may include openings which may be aligned with openings 106 such as slots or holes in a third brass shield (as shown by the dashed lines 104) so as to account for shooting ranges which higher ceilings or to provide added protection in the event the that shield adaptor system cannot reach the ceiling. The fasteners attaching the second and third brass shields have been omitted for clarity.

Figure 4:
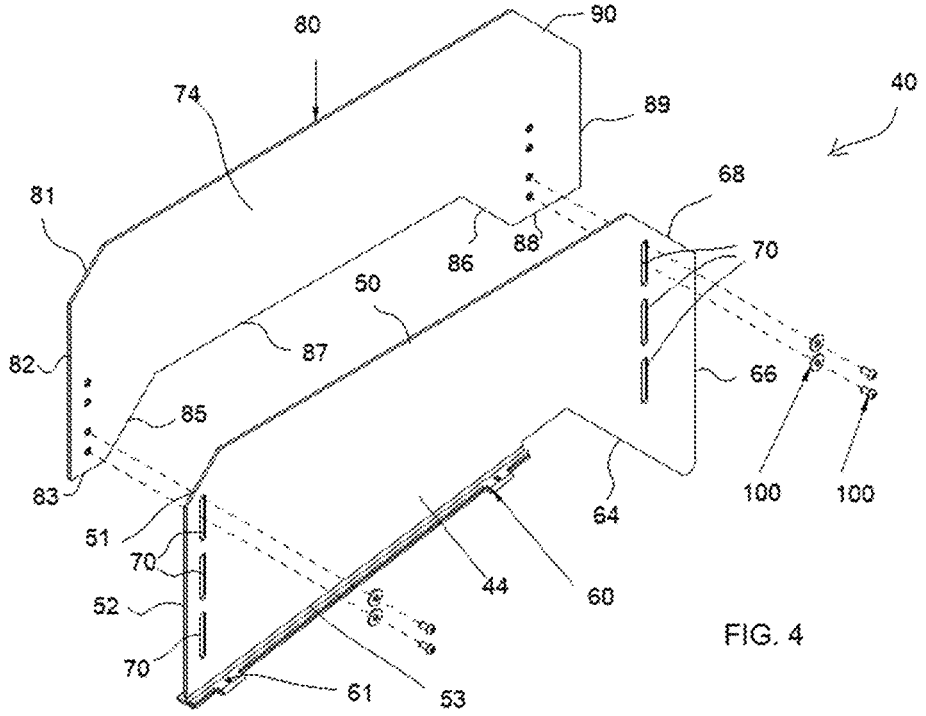
FIG. 4 shows an alternate first brass shield and second brass shield and fasteners as may be used with a stall panel having a different upper surface.

Turning now to FIG. 4, there is shown a perspective view of a brass shield adaptor system, generally indicated at 40. The brass shield adaptor system 40 may include a first brass shield 44 and a second brass shield adaptor 74. The first brass shield 44 may include a generally flat top surface 50, a short, angled forward surface 51 leading to generally flat front surface 52, a flat lower surface 53 along which a mounting bracket 60 is disposed. The mounting bracket 60 may include holes 61 for screws or other fasteners to secure the mounting bracket to a stall panel such as that shown in FIG. 1.

Rearwardly of the flat lower surface 52 may be a rearward portion 64 which extends downwardly and rearwardly from the central portion to a lower end 64 which leads to a rear surface 66 which may lead to an upwardly angled rear upper surface 67 which returns to the generally flat top surface 50. Such a shape enables the first brass shield 44 to rest securely on top of an Action Target shooting stall panel.

Unlike the brass shield 24 shown in FIG. 1, the first brass shield 44 in FIG. 4 includes a plurality of slots or openings 70 which may extend generally vertically. This may include openings 70 which are vertical or disposed at a slant. While three openings 70 are shown, the openings may include at least one opening and may include many openings depending on the size and shape of the openings.

Figure 5:
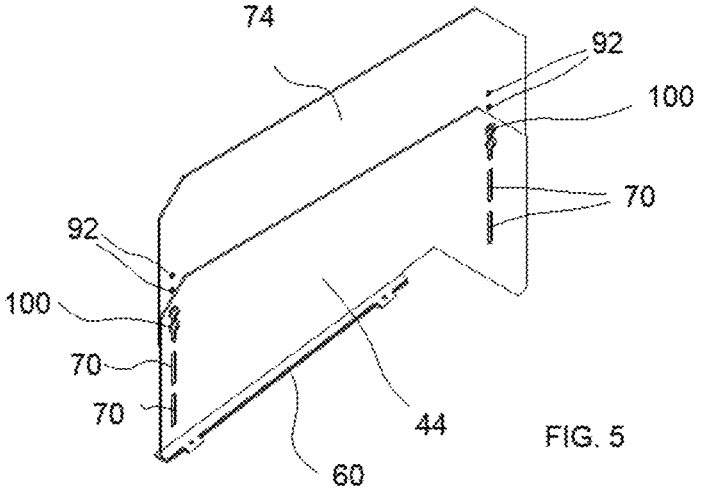
FIG. 5 shows the first brass shield and second brass shield of FIG. 4 connected together to form a brass shield adaptor system.

FIG. 5 shows a brass shield adaptor system, generally indicated at 40, formed by the first brass shield 44 attached to the second brass shield 74 by the fasteners 100 which may also be screws which anchor into one of the openings 70 or 92.

Figure 6:
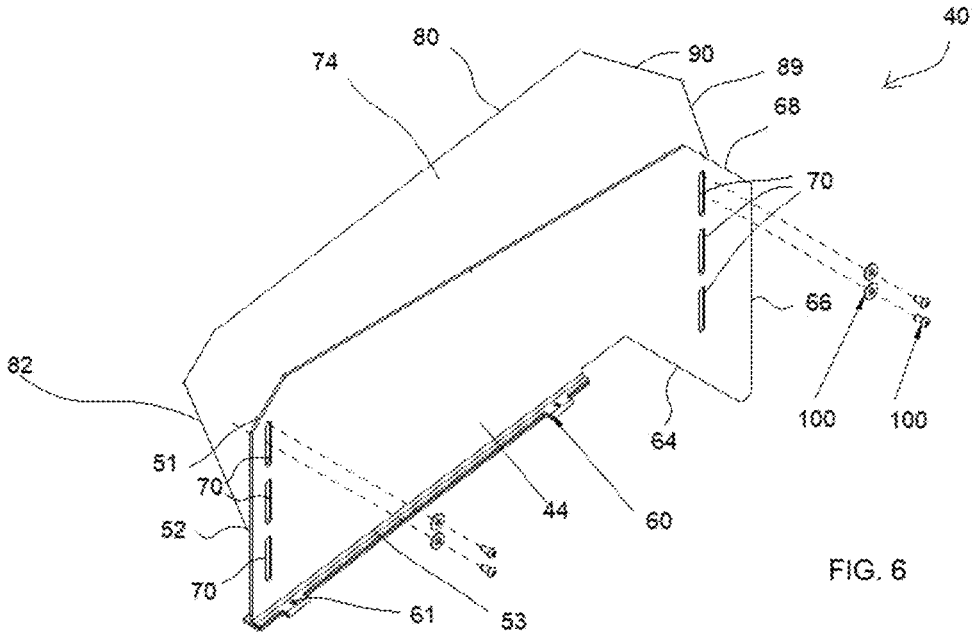
FIG. 6 shows an alternate attachment of the first shield to the second shield to engage a sloped ceiling.

FIG. 6 shows a brass shield adaptor system, generally indicated at 40, wherein the attachments points between first brass shield 44 and the second brass shield 74 are selected so that the second brass shield is tilted relative to the first brass shield, so that the top surface 80 of the second brass shield is not parallel to the ground to thereby allow the second brass shield to accommodate a ceiling which is not level.

Figure 7:
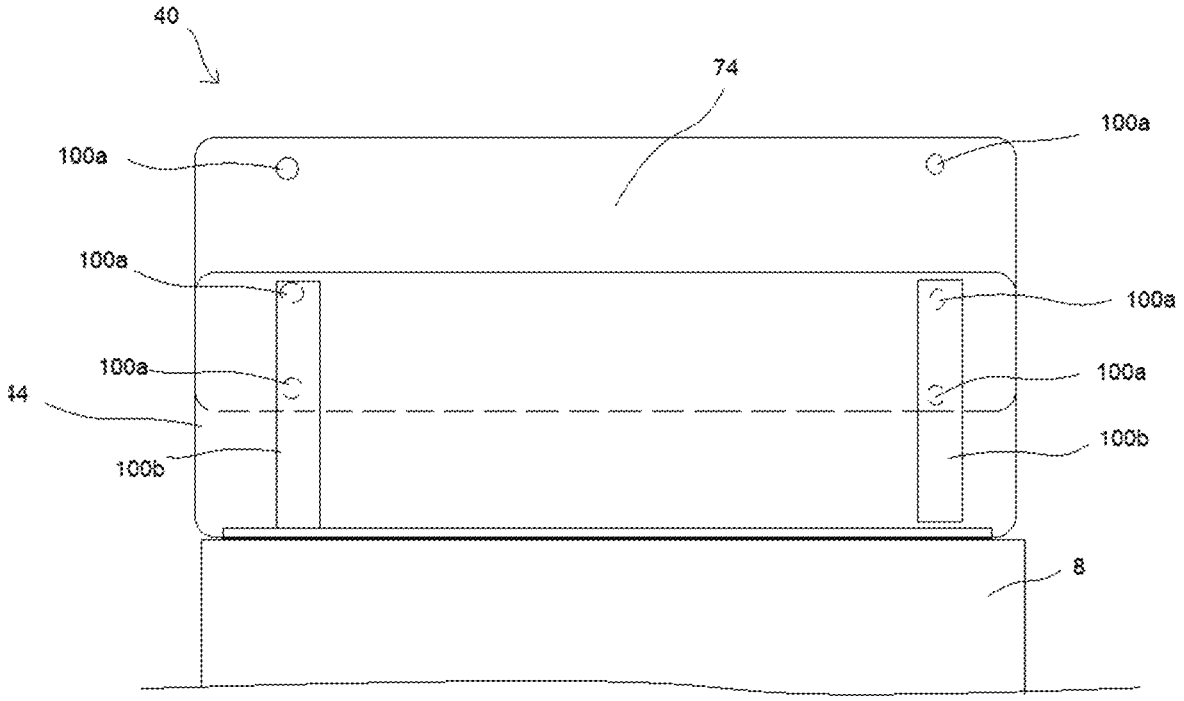
FIG. 7 shows yet another embodiment of an adjustable brass shield.

FIG. 7 shows a brass shield adaptor system, generally indicated at 40, wherein one of the brass shields (such as first shield 44) has ferromagnetic material, such as one or more steel or iron bars 100*c* disposed therein. Another of the brass shields (such as brass shield 74) may have one or more magnets 100*d* so as to form a fastener to hold the brass shields together at a desired height to inhibit brass from passing from one stall to another.

Thus, there is disclosed a brass shield adaptor system. It will be appreciated that modifications can be made without departing from the scope and spirit of the invention. The appended claims are intended to cover such modifications.

What is claimed is:

1. A brass shield adaptor system for attachment on a top of a shooting stall, the brass shield adaptor system having a first brass shield having a top and a bottom and a mounting bracket disposed along the bottom of the first brass shield for attaching the first brass shield to the top of a shooting stall, the first brass shield having a front surface and a rear surface at opposing ends of the first brass shield, the first brass shield having a plurality of openings extending from one side of the first brass shield to an opposing side of the first brass shield; and a second brass shield having a top and a bottom and a front surface and a rear surface and the second brass shield having a plurality of openings disposed therein, the first brass shield being releasably attached to the second brass shield and wherein when fasteners extend through openings of the plurality of openings in the first brass shield and openings of the plurality of openings in the second brass shield, the top of the second brass shield is disposed above the top of the first brass shield and wherein the bottom of the second brass shield is disposed below the top of the first brass shield.

2. The brass shield adaptor system according to claim 1, wherein the first brass shield is an elongate flat piece of material extending from the front surface to the back surface, the material having sides between the front surface and the back surface and wherein the plurality of openings in the first brass shield includes a first group of openings disposed adjacent to but spaced rearwardly from the front side, and a second group of openings disposed adjacent to but spaced from the rear surface such that the first group of openings and the second group of openings are spaced apart from each other.

3. The brass shield adaptor system of claim 2, wherein at least one of the first group of openings and the second group of openings comprises at least one opening which forms an elongate slot.

4. The brass shield adaptor system of claim 1, wherein the plurality of openings of at least one of the first brass shield and the second brass shield includes a plurality of elongate slots such that when fasteners extend through the group of openings in the first brass shield and the second brass shield, the second brass shield is able to slide vertically with respect to the first brass shield.

5. The brass shield adaptor system of claim 4, further comprising a plurality of fasteners for holding the second brass shield to the first brass shield.

6. The brass shield adaptor system of claim 5, wherein the plurality of openings in the first brass shield comprises a plurality of elongate slots and wherein the plurality of openings in the second brass shield comprises a plurality of holes, the plurality of elongate slots being positioned such that when the fasteners extend through the plurality of elongate slots and the plurality of holes, the second brass shield can be rotated relative to the first brass shield.

7. The brass shield adaptor system of claim 1, wherein the first brass shield has a generally flat top surface and wherein the second brass shield as a generally flat top surface and wherein the second brass shield is tilted vertically relative to the first brass shield so that the generally flat top surface of the second brass shield is not parallel to the generally flat top surface of the first brass shield and is angle upwardly relative to a ground surface.

8. The brass shield adaptor system of claim 1, wherein the bottom of the first brass shield has a flat lower surface and a rearward portion extending downwardly from the flat lower surface.

9. The brass shield adaptor system of claim 1, wherein the plurality of openings in the first brass shield includes a first plurality of generally vertical elongate slots disposed near the front surface, and a second plurality of generally vertical elongate slots spaced horizontally away from the first plurality of generally vertical elongate slots and disposed toward the rear surface.

10. The brass shield adaptor system of claim 1, further comprising a third brass shield attached to and extending upward from the second brass shield.

11. A brass shield adaptor system for mounting on a shooting stall panel comprising:

first elongate flat piece of material having a front surface at one end and a rear surface and elongate sides extending lengthwise between the front surface and the rear surface, the first elongate piece having a top and a bottom, the bottom including a bracket for fastening the first elongate flat piece of material on a top of a shooting stall panel, a second elongate flat piece of material having a front surface and a rear surface and elongate sides extending lengthwise between the front surface and the rear surface; the second elongate flat piece of material having a top and a bottom, and at least one fastener for holding an elongate side of the first elongate flat piece against an elongate side of the second elongate flat piece so that the top of the second elongate flat piece of material is disposed above the top of the first elongate piece of material, the at least one fastener allowing the second elongate piece of material to be adjusted while the second elongate piece of material is attached to the first elongate piece of material by the at least one fastener.

12. The brass shield adaptor system of claim 11, wherein the bottom of the first elongate flat piece of material has a rearward portion which slopes downwardly from the bracket.

13. The brass shield adapter of claim 11, wherein one of the first elongate flat piece of material and the second elongate flat piece of material has a plurality of elongate slots through the elongate sides thereof.

14. The brass shield adaptor of claim 13, wherein the plurality of elongate slots includes a plurality of slots through the elongate sides adjacent the front surface and a plurality of slots through the elongate sides adjacent the rear surface.

15. The brass shield adaptor of claim 14, further comprising a plurality of fasteners extending through and being movable between opposing ends of at least one slot in the plurality of slots.

16. The brass shield adaptor of claim 11, wherein the second elongate flat piece of material slides relative to the first elongate flat piece of material vertically so as to change a distance at which the top of the second elongate flat piece of material extends above the top of the first elongate flat piece of material.

17. The brass shield adaptor of claim 11 wherein the second elongate flat piece of material can rotate relative to the first elongate flat piece of material so as to change an angle at which the top of the second elongate flat piece of material is disposed.

18. The brass shield adaptor of claim 11 comprising at least one magnetic fastener.

19. The brass shield adaptor of claim 11, further comprising a third elongate flat piece of material attached to the second elongate flat piece of material.

20. The brass shield adaptor of claim 11, further comprising openings in one of the first elongate flat piece of material and the second elongate flat piece of material comprising three vertical slots disposed vertically above one another and through the elongate sides adjacent the front surface and three vertical slots disposed vertically above one another adjacent the rear surface.

21. A method of forming a brass shield on a shooting stall, the method comprising in no particular order:

selecting a first elongate flat piece of material having a front surface at one end and a rear surface and elongate sides extending lengthwise between the front surface and the rear surface, the first elongate flat piece having a top and a bottom, the bottom including a bracket for fastening the first elongate flat piece on the top of a shooting stall panel, attaching the bracket of the first elongate flat piece of material to the top of a panel of a shooting stall, selecting a second elongate flat piece of material having a front surface and a rear surface and elongate sides extending lengthwise between the front surface and the rear surface; the second elongate flat piece of material having a top and a bottom, and attaching the second elongate flat piece of material to the first elongate flat piece of material with at least one fastener for holding an elongate side of the first elongate flat piece against an elongate side of the second elongate flat piece so that the top of the second elongate flat piece of material is disposed above the top of the first elongate piece of material, the at least one fastener allowing the second elongate piece of material to be adjusted while the second elongate piece of material is attached to the first elongate piece of material by the at least one fastener; and adjusting the position of the second elongate flat piece of material relative to the first elongate flat piece of material.

* * * * *